US005573347A

United States Patent [19]

Miles et al.

[11] Patent Number: 5,573,347

[45] Date of Patent: Nov. 12, 1996

[54] DRAIN PREPARATION APPARATUS AND METHOD OF USING SAME

[76] Inventors: Robert K. Miles, 2182 Fort Jackson Rd.; C. Ray Miles, 1505 Portercross Rd., both of Lugoff, S.C. 29078

[21] Appl. No.: 250,903

[22] Filed: May 31, 1994

[51] Int. Cl.[6] ..... F16L 1/02; E02B 11/00

[52] U.S. Cl. ..... 405/43; 405/36; 405/179

[58] Field of Search ..... 405/43–49, 179, 405/154–157, 38; 37/462, 347, 352, 142.5

[56] References Cited

U.S. PATENT DOCUMENTS

| | | | |
|---|---|---|---|
| 1,180,164 | 4/1916 | Lorio | 37/347 |
| 1,705,502 | 3/1929 | Schellentrager | 222/135 |
| 1,767,017 | 6/1930 | Scheckler | 37/347 |
| 2,007,969 | 7/1935 | Grodsky | 61/72 |
| 2,290,325 | 7/1942 | Hammond | 37/462 |
| 3,300,989 | 1/1967 | Reising | 62/72 |
| 4,289,424 | 9/1981 | Shefbuch et al. | 405/179 |
| 4,806,043 | 2/1989 | Fournier | 404/2 |
| 4,812,078 | 3/1989 | Rivard | 405/179 |
| 4,832,531 | 5/1989 | Paulovits | 405/176 |
| 5,003,712 | 4/1991 | Mitchell | 37/352 |
| 5,070,632 | 12/1991 | Gilbert . | |
| 5,174,685 | 12/1992 | Buchanan | 405/179 |
| 5,271,168 | 12/1993 | Wilson, Sr. et al. | 37/142 |

*Primary Examiner*—Dennis L. Taylor

*Attorney, Agent, or Firm*—Fitzpatrick, Cella, Harper & Scinto

[57] ABSTRACT

An apparatus and method for preparing a drain from a trench in a single pass by lining the trench with a filter fabric, a first layer of bulk material, a drain pipe and a second layer of bulk material. A guide chute guides the filter fabric into the trench, the filter fabric being positioned in the trench adjacent the bottom and one side wall thereof. A pipe chute, having an exit portion, lays the drain pipe on the first layer of bulk material in the trench. A hopper is provided with the bulk material therein and has a first opening through which the first layer of bulk material is poured into the trench onto the filter fabric, and has a second opening through which the second layer of bulk material is poured into the trench onto the drainage pipe. A slidable gate may be provided to control the flow of bulk material through the second opening to permit the installation of lateral drains.

38 Claims, 12 Drawing Sheets

DRAIN PREPARATION APPARATUS AND METHOD OF USING SAME

BACKGROUND OF THE INVENTION

1. Field of the Invention

The present invention relates generally to an apparatus for preparing a drainage trench, such as a trench positioned adjacent to the side of a roadway to drain water from the road subbase. More specifically, the invention relates to a drain preparation apparatus which performs at least the following steps in a single pass: lining the bottom and a single side wall of the trench with a filter fabric, pouring a first layer of bulk material on the filter material, laying a drainage pipe on the first layer of bulk material and pouring a second layer of bulk material on the drainage pipe to cover the pipe and fill the trench.

2. Description of the Prior Art

It is customary practice among civil engineers and road construction experts today to provide drains along roadways to allow for proper drainage of water from road subbases to thereby avoid subbase failure and to prolong the life of road pavement. Typically, such drains are constructed by first digging a trench parallel to the edge of the roadway using a conventional trench digging machine, backhoe or the like.

To prepare the drain, the trench must first be lined with a suitable filter fabric to provide a permeable barrier between the bottom and sides of the trench and the drain pipe. Such a permeable structure prevents the flow of silt or the like into the drain pipe. After the filter fabric is laid, a first layer of bulk granular material, such as draincrete, gravel or the like, is poured into the bottom of the trench. A pipe through which the water may drain is then laid on top of the first layer of bulk material, after which a second layer of bulk material is poured to cover the pipe and to fill the trench.

The preparation of a drain from a bare trench is thus a multi-step process, involving the sequential performance of various tasks which can only be performed after previous steps have been completed. As a result, the drain preparation process is very time consuming and therefore expensive. In addition to being time consuming, the process has also historically required the use of different apparatus to perform the different steps, adding further to the complexity, labor and cost of the process.

Prior art apparatus for performing more than one of the various steps necessary to prepare a trench for use as a drain have been attempted in the past. For example, U.S. Pat. No. 4,289,424 to Shefbuch, et al. discloses an apparatus for laying a drain conduit in a trench, together with embedment material. The Shefbuch, et al. apparatus includes a hopper with a drain pipe chute 45 running through it. The discharge end of chute 45 protrudes through a bottom rear opening in the hopper so that pipe and gravel are simultaneously laid in the trench bottom as the apparatus is towed by a conventional trenching machine.

U.S. Pat. No. 4,806,043 to Fournier discloses a machine for lining a trench with filter cloth 14, laying down a drain pipe 15 directly on filter cloth 55, filling the trench with gravel 34, and then sealing the top edges of filter cloth 14 together to encase the drain pipe and gravel.

U.S. Pat. No. 4,812,078 to Rivard discloses a machine for simultaneously laying a conduit such as a telephone cable 6 and sand 41 (which surrounds the conduit) in a trench, laying a marker film 55 on top of the sand, and then back-filling the trench using plowshares 61 and 61A.

U.S. Pat. No. 4,832,531 to Paulovits discloses an apparatus for simultaneously laying irrigation pipe and a strip of water-impervious plastic film (underneath the pipe) in a small trench about 60 centimeters deep. The apparatus includes a splitting tool to provide a slit in the ground and a wing type hollow head for widening the slit underground. The plastic film is fed to the hollow head in folded form and is unfolded by guiding means associated with the head before it is laid on the bottom of the subterranean trench.

U.S. Pat. No. 5,174,685 to Buchanan purports to improve over the Shefbuch, et al. '424 patent and discloses tapering the hopper from rear to front. Because of the taper, it is alleged that only the rear corners of the hopper engage the side walls of the trench, thus creating minimal frictional resistance.

While the prior art, as exemplified by the patents discussed above, has attempted to provide apparatus capable of performing multiple drain preparation steps in a single pass, each of the apparatus discussed above has various disadvantages which make them less than satisfactory for prolonged commercial use. For example, no means are disclosed in Fournier for pouring a first layer of bulk material before laying the drainage pipe in the trench. In addition, in Fournier, filter material 14 is laid in the trench by pressure from drainage pipe 15. As a result, filter material 14 will not seat tightly and evenly along the sides and bottom of the trench.

Still further, Fournier teaches laying filter material on all three sides of the trench, that is, on both vertical walls and the bottom of the trench. In practice today, however, some State Highway Departments, such as South Carolina, require that the trench be lined only on the bottom and on the side wall farthest from the road. This construction is mandated by the South Carolina Highway Department to increase the flow of water from underneath the road surface into the drain. The Fournier apparatus cannot meet this requirement.

Shefbuch, et al. provides means for pouring bulk material into a trench but does so simultaneously with the laying of pipe 15. As a result, irregularities can result in the positioning of pipe 15 and in the amount of bulk material which is poured above and below the pipe, thus reducing the effectiveness of the draining operation. In addition, the Shefbuch, .et al. apparatus discloses no means for laying a filter material in the trench.

Buchanan suffers from the same limitations as Shefbuch, et al.

Accordingly, it is an object of the present invention to provide a drain preparation apparatus for performing in a single pass at least the steps of lining a trench with a filter material, laying a first layer of bulk material on the filter material, laying a drainage pipe on the first layer of bulk material and laying a second layer of bulk material on the drainage pipe to cover the pipe and fill the trench.

It is a further object of the present invention to provide a drain preparation apparatus wherein the flow of the second layer of bulk material may be controlled to enable the drain preparation apparatus to satisfactorily prepare lateral drains.

It is yet a further object of the present invention to provide an improved apparatus for guiding and folding the filter material and laying the folded filter material on the bottom and only one side wall of the trench.

It is a still further object of the present invention to provide a soil recovery apparatus adapted to be used with a conventional trenching machine, the soil recovery apparatus recovering soil dislodged by the trenching machine so that the resulting trench is substantially free from berms of soil created adjacent the sides of the trench.

Additional objects and advantages of the invention will be set forth in part in the description which follows, and in part will be obvious from the description, or may be learned by practice of the invention. The objects and advantages of the invention will be realized and attained by means of the elements, combinations and methods particularly pointed out in the appended claims.

SUMMARY OF THE INVENTION

To achieve the above objects and in accordance with the purpose of the invention, as embodied and broadly described herein, according to a first preferred embodiment of the present invention there is provided an apparatus for preparing a drain from a trench in a single pass by lining the trench with a filter fabric, a first layer of bulk material, a drain pipe and a second layer of bulk material. A guide chute guides the filter fabric into the trench, the filter fabric being positioned in the trench adjacent the bottom and one side wall thereof. A pipe chute, having an exit portion, lays the drain pipe on the first layer of bulk material in the trench. A hopper is provided with the bulk material therein and has a first opening through which the first layer of bulk material is poured into the trench onto the filter fabric, and has a second opening through which the second layer of bulk material is poured into the trench onto the drainage pipe. A slidable gate may be provided to control the flow of bulk material through the second opening, thus permitting the preparation of lateral drains.

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

Figure 1:
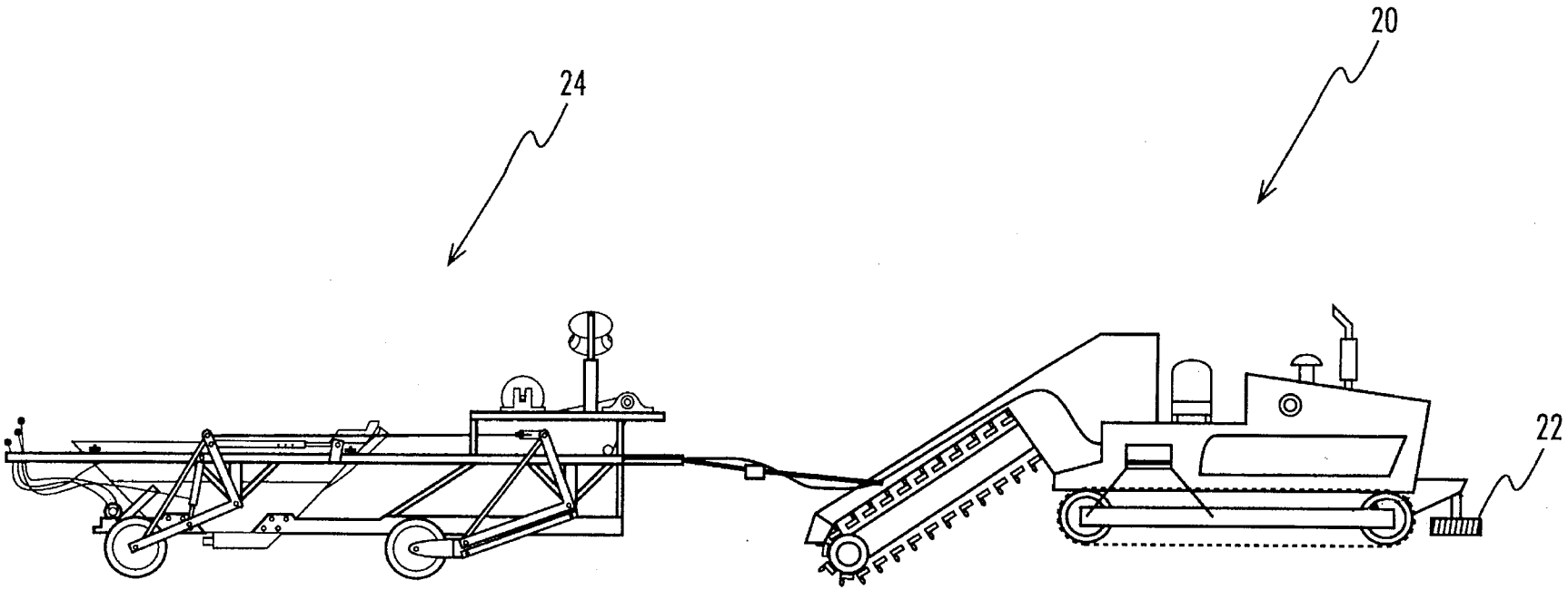
FIG. 1 illustrates a drain preparation apparatus according to the present invention adapted to be pulled behind a conventional trenching machine.

Referring to FIG. 1, there is illustrated a conventional trenching machine 20 for digging a trench, such as a drainage trench found adjacent to many roadways. Trenching machine 20 is a self-propelled device such as, for example, a Vermeer Model T 455 trenching machine.

As further illustrated in FIG. 1, according to the present invention, trenching machine 20 is provided with a guide wheel 22, which is movably mounted to trenching machine 20. Guide wheel 22 preferably comprises a rotatable, horizontally disposed wheel made of a resilient material, such as a solid fork lift tire or the like. Guide wheel 22 extends in front of (that is, in the direction of movement while digging) trenching machine 22 and is movable in both the vertical and horizontal directions, such that when trenching machine 20 is driven along the side of a roadway, then guide wheel 22 may be positioned to abut the side of the road to maintain trenching machine 20 a predetermined distance therefrom. As a result, guide wheel 22 continuously maintains trenching machine 20 at a constant optimum distance from the side of the road as trenching machine 20 digs the trench.

The particular means by which the position of guide wheel 22 is adjusted in the horizontal direction preferably comprises a mechanical adjustment, such as adjustable mounting hardware or the like, the particular configuration of which may be readily selected by those of ordinary skill in the art. The position of guide wheel 22 is preferably adjustable in the vertical direction by means of hydraulically powered pistons or the like provided on trenching machine 20. Of course, other means for adjusting the position of guide wheel 22 may also be employed, as will be apparent to those of ordinary skill in the art, without departing from either the spirit or scope of the present invention.

The drain preparation apparatus of the present invention, illustrated generally by reference numeral 24 in FIG. 1, is shown therein adapted to be pulled behind trenching machine 20 as trenching machine 20 travels along the side of a road. Alternatively, drain preparation apparatus 24 may be pulled (or pushed) by other means or, alternatively, may be self propelled by an engine, motor or the like (not shown).

Figure 2:
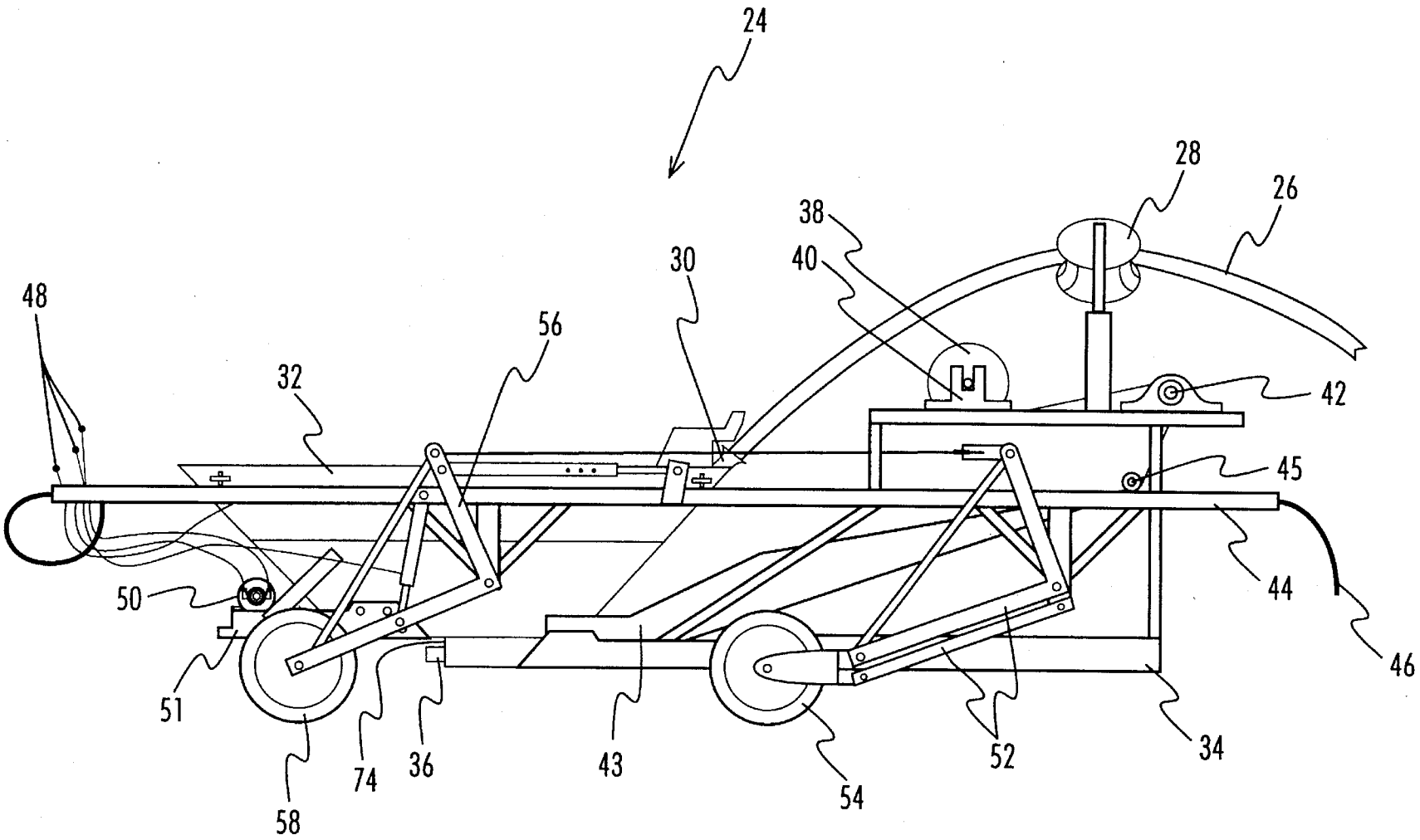
FIG. 2 illustrates the drain preparation apparatus of FIG. 1 including a drain pipe to be laid by the apparatus.
Figure 3D:
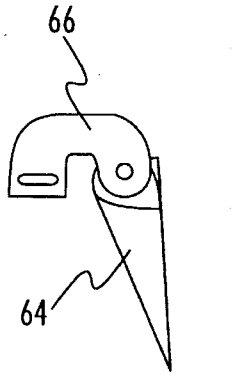
FIGS. 3A, 3B, 3C and 3D (hereafter sometimes collectively FIG. 3) illustrate various elements of the drain preparation apparatus illustrated in FIGS. 1 and 2 for feeding filter material from a roll, guiding the filter material toward a trench, folding the filter material into a predetermined configuration and laying the filter material in the trench.
Figure 3B:
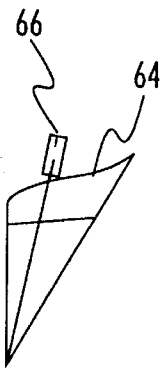
Figure 3A:
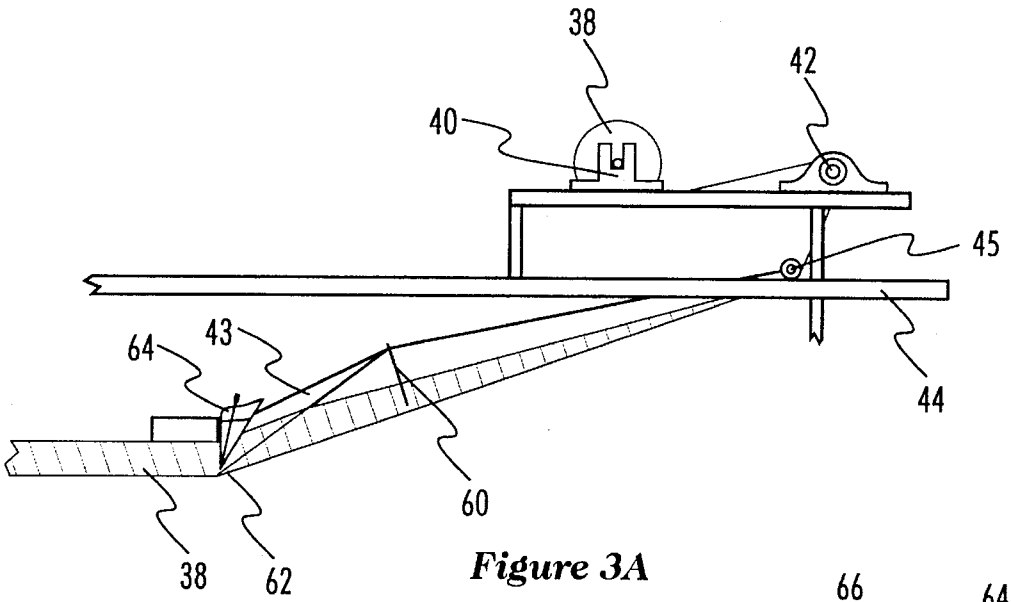
Figure 3C:
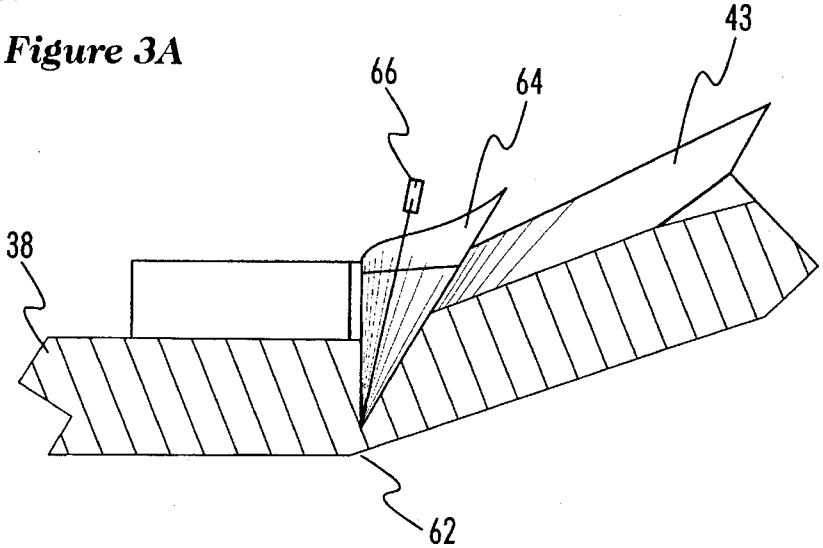
Figure 4A:
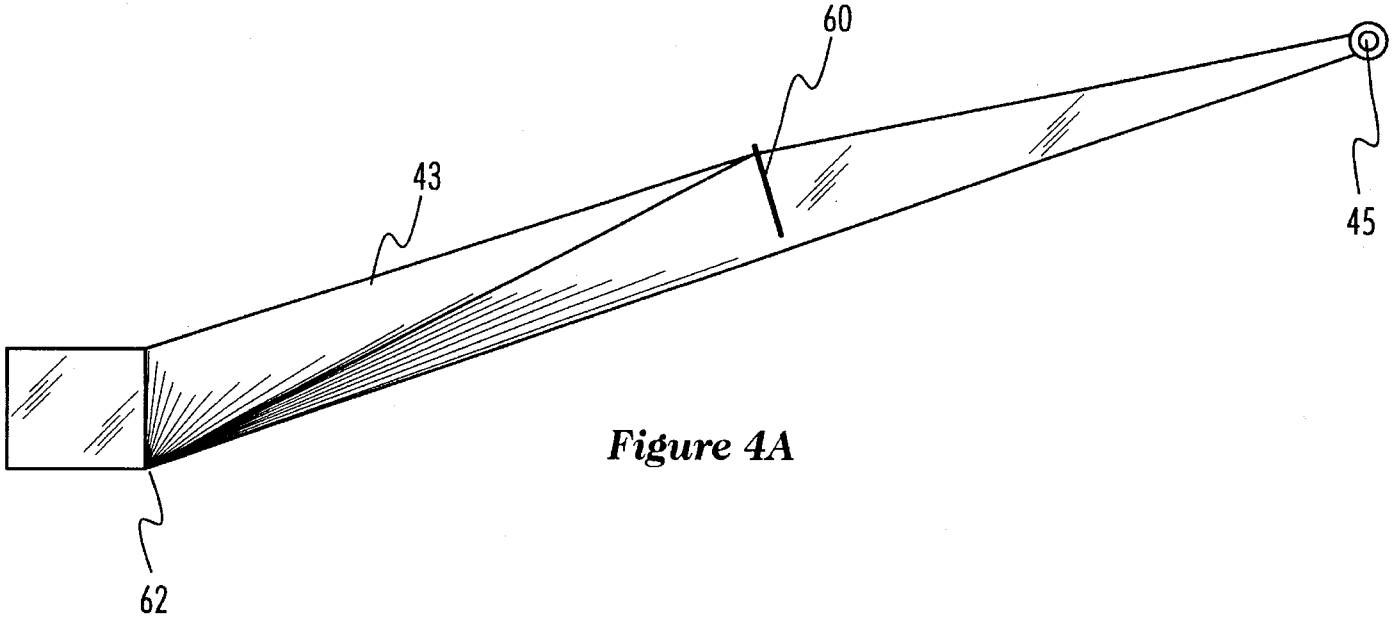
FIGS. 4A and 4B are a side view and a top view, respectively, of elements illustrated in FIGS. 3A, 3B and 3C that guide and fold the filter material prior to the filter material being laid in the trench.
Figure 4B:
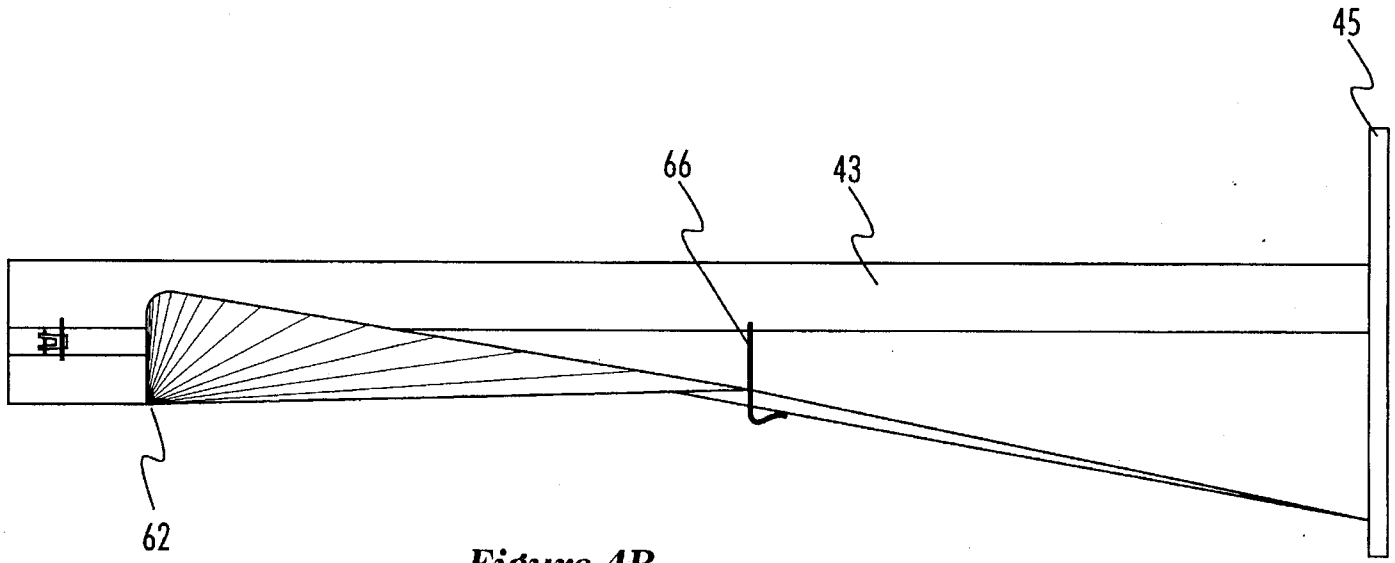
Figure 5A:
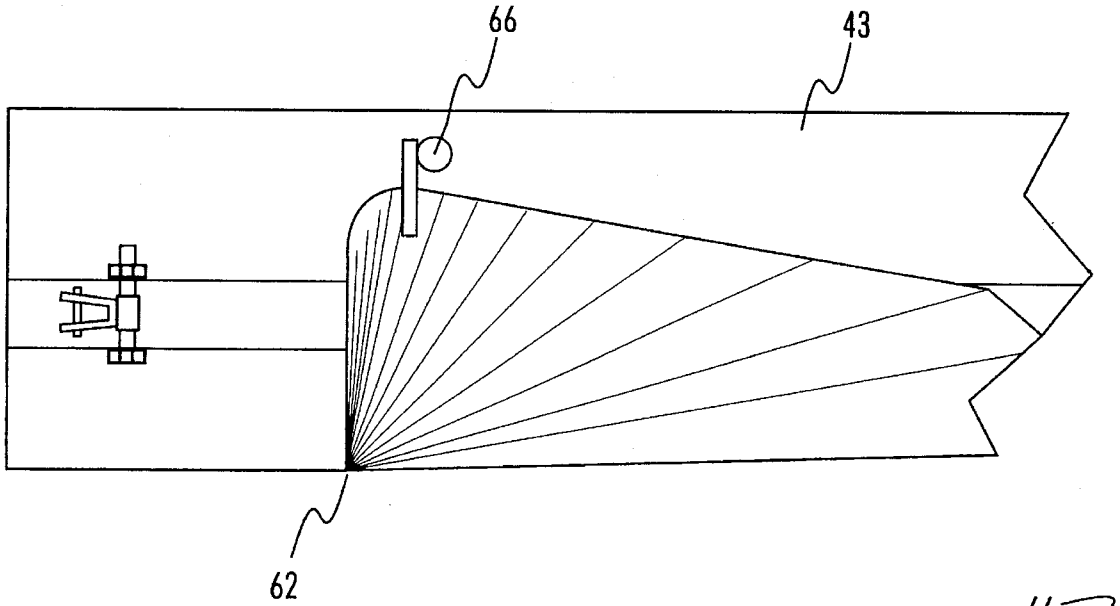
FIGS. 5A and 5B are further views of elements illustrated in FIGS. 3A, 3B and 3C that guide and fold the filter material prior to the filter material being laid in the trench.
Figure 5B:
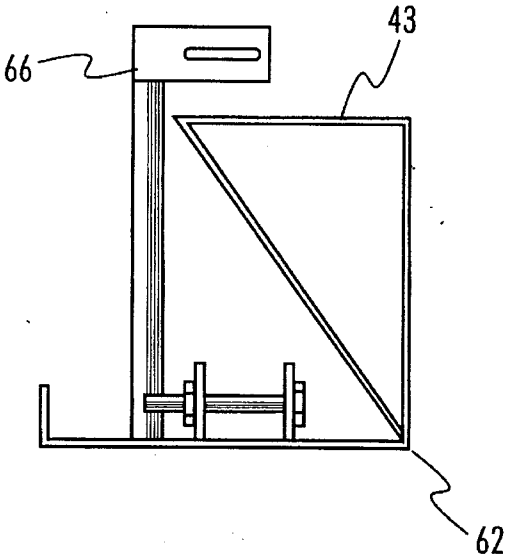
Figure 6:
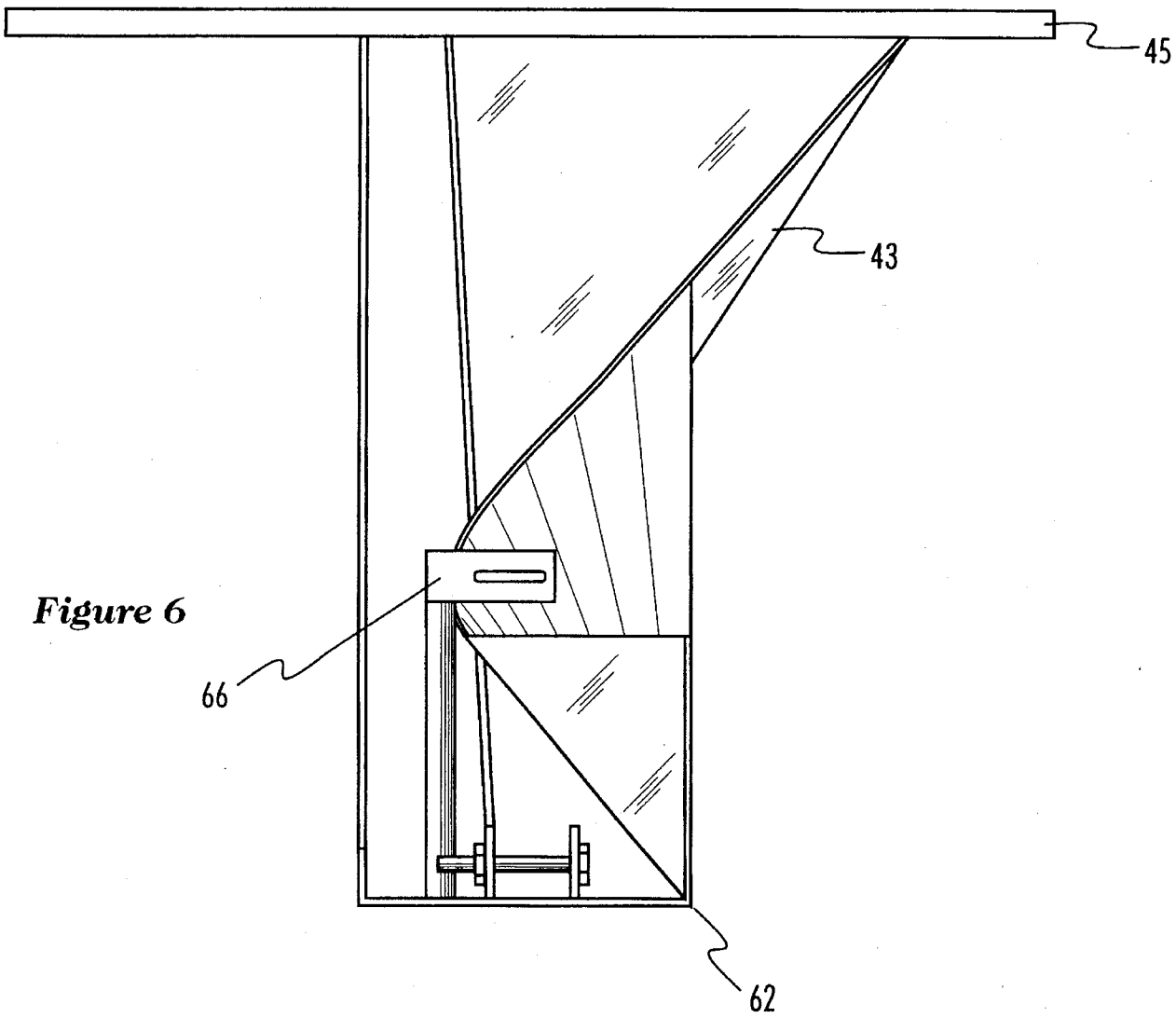
FIG. 6 is an additional partial view of elements that guide, fold and lay the filter material in the trench illustrated in FIGS. 3A through 5B.

Referring now to FIG. 2, there is illustrated a preferred embodiment of drain preparation apparatus 24. As shown therein, a conventional flexible drain pipe 26, which preferably has been unrolled in advance along the direction of travel of drain preparation apparatus 24, is received by a feeding wheel 28. Feeding wheel 28 is preferably made of metal or other durable construction and is rotatable in a direction opposite to the direction of travel of drain preparation apparatus 24. A motor or other suitable electrical or mechanical means (not shown) optionally may be provided to facilitate the rotation of feeding wheel 28. Feeding wheel 28 includes a curved, recessed inner guide portion, having a width slightly larger than the width of drain pipe 26, through which drain pipe 26 may pass. Side portions of feeding wheel 28 extend radially outward to hold drain pipe 26 in the recessed inner portion. Drain pipe 26, guided by feeding wheel 28, passes into a pipe chute 30, which further guides drain pipe 26 into the trench through an exit portion 36 thereof. The particular length and diameter of exit portion 36 of pipe chute 30 may be determined in accordance with the diameter of drain pipe 26. In a preferred embodiment, the inner diameter of exit portion 36 is approximately 5".

Drain preparation apparatus 24 is further provided with a hopper 32. Hopper 32 is an open-topped vessel made of metal or other suitable durable construction for receiving bulk material, such as draincrete, gravel or the like, from a concrete truck or the like (not shown), and for distributing the bulk material through a pair of openings therein into the trench. Hopper 32 may take any of various configurations, however, a presently preferred configuration of hopper 32, including the specific elements which release the bulk material into the trench, will be discussed in more detail below in connection with FIG. 7 and 8.

Adjacent to hopper 32 and extending longitudinally toward the front of apparatus 24 (i.e., to the right looking at FIG. 2) is a hopper centering guide 34. Hopper centering guide 34 is preferably a rectangular-shaped bar, which may be solid or hollow, made of metal or other suitable durable material. When drain preparation apparatus 24 is in operation, hopper centering guide 34 is positioned in the trench created by trenching machine 20 and is positioned in the vertical direction such that the bottom surface of hopper centering guide 34 lightly contacts the bottom of the trench. The distal end of hopper centering guide 34 (that is, the end on the right hand side in FIG. 2) is closed and the width of the distal end is selected to correspond substantially to the width of the trench. In operation, hopper centering guide 34 travels in the trench to keep drain preparation apparatus 24 centered in the trench, to avoid pinch points and to maintain proper clearance of apparatus 24 so as to allow for free movement of filter fabric, as discussed in more detail below. Hopper centering guide 34 further helps to ensure proper placement of the filter fabric in the trench before the bulk material is poured onto the fabric. Hopper centering guide 34 is preferably mounted directly or indirectly to frame 44 (discussed below).

The filter fabric to be laid in the trench, represented generally by element 38 in FIG. 2, is preferably stored on a roll, spool or the like which may easily be fed out. Filter fabric may be of any material having a suitable weight, permeability and porosity such as, for example, 4 oz./yard fabric, Specification No. 4420TZ, available from Spartan Technicians of Spartansburg, S.C., or the like. The roll of filter fabric 38 is mounted, for example, by a pair of oppositely facing mounting brackets 40 disposed on an upper surface of apparatus 24. Mounting brackets 40 are configured to secure filter fabric 38, while allowing the fabric to be fed off of the roll so that filter fabric 38 may be laid in the trench.

Mounting brackets 40 are preferably adjustable in the lateral (that is, left and right) direction to permit the roll of filter fabric 38 to be optimally positioned thereon. That is, due to variations in the particular configurations of the elements described herein, as well as in the width of the roll of filter fabric 38, the position of the roll within mounting brackets 40 may be adjusted to align the roll with fabric guide chute 43 (discussed below) to thus ensure that filter fabric 38 is properly positioned in the trench. The position of the roll of filter fabric 38 in mounting brackets 40 may, for example, be adjusted using removable retaining pins placed in variously positioned holes.

To prevent an excessive amount of slack from developing in the roll of filter fabric 38, there also may be provided tension applying element, such as a rubber belt or the like (not shown), which is positioned in contact with an outer surface of the roll of filter fabric 38 and which is configured to maintain an acceptable amount of tension on the roll. Preferably, the configuration of the tension applying element is adjustable so as to maintain a substantially constant amount of tension on the roll of filter fabric 38 as the outer diameter of the roll decreases due to the filter fabric 38 being laid in the trench.

After being fed from the underneath of the roll, filter fabric 38 passes over a rotatable and longitudinally adjustable filter fabric roller 42. A motor or other suitable electrical or mechanical means (not shown) optionally may be provided to facilitate the rotation of roller 42 and thus the feeding of filter fabric 38 from the roll. From roller 42, filter fabric 38 then contacts an outer surface of a fabric guide chute 43, which serves to guide and fold filter fabric 38 as it is laid into the trench. The presently preferred best mode contemplated for fabric guide chute 43 and for additional elements for guiding, folding and laying filter fabric 38 into the trench will be discussed in detail below in connection with FIGS. 3 through 6.

The various elements of drain preparation apparatus 24 are supported by a frame 44, made of metal or other suitable durable construction. The particular dimensions and configurations of frame 44 are not crucial to the practice of the present invention and may be altered, as necessary, in accordance with accepted engineering principles without departing from the spirit or scope of the present invention.

The electrical power necessary to power certain of the operations performed by drain preparation apparatus 24 may be provided from a conventional power source (not shown) located on trenching machine 20 through an electrical power conduit 46. As envisioned herein, other connections between drain preparation apparatus 24 and trenching machine 20, such as, for example, hydraulic hoses, control wires and the like (not shown), may also pass from trenching machine 20 to drain preparation apparatus 24 through conduit 46. Power to operate drain preparation apparatus 24 alternatively may be provided from a battery or other power source (not shown) mounted directly on drain preparation apparatus 24.

Power is provided through electrical power conduit 46 to a set of controls, identified generally as element 48 in FIG. 2. The particular position of controls 48 is not crucial to the practice of the present invention. Controls 48 may be positioned as desired by the user to permit ready access thereto. Controls 48 preferably comprise at least four individual controls, which control, for example, the height of the left side of apparatus 24, the height of the right side of apparatus 24, the position of a gate used to control the flow of bulk material from hopper 32 and the operation of various vibrators which may be used to facilitate the flow of bulk material from hopper 32. The control of these particular operations will be discussed in further detail below. Of course, the particular controls identified herein should be considered as being exemplary only. In accordance with the present invention, controls 48 may comprise additional individual controls for controlling still further functions of apparatus 24.

Drain preparation apparatus 24 is preferably provided with one or more vibrators, the sizes, configurations and locations of which may be selected as desired to facilitate the flow of and prevent caking of the bulk material in hopper 32. For example, as illustrated in FIGS. 2 and 10A, a vibrator 50 may be positioned adjacent a lower portion of hopper 32, near exit portion 36. Vibrator 50 may comprise any of a variety of suitable commercially available rotary vibrators such as, for example, the Design series of hydraulic vibrators available from Global Manufacturing, Inc. of Little Rock, Ark. Vibrator 50 is mounted such that in operation the vibration of vibrator 50 is transferred to hopper 32 through, for example, a mounting bracket 51 or other suitable hardware, to facilitate the flow of bulk material through hopper 32.

Apparatus 24 is designed to prepare drains on either side of the road. Because today's roads typically crest in the center and slope downward on the sides (often at a severe slope beyond the shoulder of the road), and because the road shoulder may have been removed to insert a drain, thus creating a step-like configuration, apparatus 24 is provided with individually adjustable leg assemblies to ensure that hopper 32, centering guide 34 and the other elements of apparatus 24 remain substantially level as apparatus 24 travels along the side of the road, notwithstanding variations in the slope of the terrain that may be encountered. Specifically, there are provided left and right front leg assemblies 52 and left and right rear leg assemblies 56. (Because FIG. 2 is a side view, only one front leg assembly and one rear leg assembly are shown). Front and rear leg assemblies 52, 56 are connected to front and rear wheels 54, 58, respectively. The height of the front and rear leg assemblies (and therefore of front and rear wheels 54, 58), is preferably individually controlled by controls 48 to ensure an optimum operating position of apparatus 24 as it is being used. The particular preferred embodiment for controlling the height of front and rear wheels 54, 58 will be discussed in more detail below in connection with FIG. 11.

The presently preferred embodiment for guiding, folding and laying filter fabric 38 into the trench will now be discussed with reference to FIGS. 3 through 6. As shown therein, fabric guide chute 43 is removably and rotatably connected to frame 44 at a supporting edge 45. Supporting edge is preferably a tube or the like provided at the upper edge of fabric guide chute 43 through which a rod secured to frame 44 may be passed, thus removably and rotatably connecting fabric guide chute 43 to frame 44. As filter fabric 38 is fed over filter fabric roller 42, filter fabric 38 contacts the outer surface of fabric guide chute 43 at supporting edge 45. Fabric guide chute 43, which is preferably made of metal or other suitable durable material, then guides and folds filter fabric 38 diagonally downward toward the trench, as illustrated in FIGS. 3 through 6 and as discussed further below.

To ensure that filter fabric 38 follows the outer surface of fabric guide chute 43, filter fabric 38 is held closely adjacent the outer surface of fabric guide chute 43 by a guide bar 60. Guide bar 60 may comprise a metal rod or the like and is removably mounted to fabric guide chute 43. Guide bar 60 extends substantially across the width of the outer surface of fabric guide chute 43 at a position intermediate supporting edge 45 and the trench. Preferably, guide bar 60 is located substantially at the mid point between supporting edge 45 and the trench.

The outer surface of fabric guide chute 43 is bent along the entire length thereof. As a result, because filter fabric 38 is held to the outer surface of fabric guide chute 43 by guide bar 60, when filter fabric 38 is guided along the outer surface of fabric guide chute 43, the shape of filter fabric 38 is folded by the bends in the fabric guide chute 43. The presently preferred configuration of fabric guide chute 43 discussed below, including the various bent surfaces in fabric guide chute 43, has been found to fold filter fabric 38 into the desired configuration to most effectively lay filter fabric 38 only along the bottom and outer vertical side wall of the trench.

Specifically, beginning at a corner of fabric guide chute 43 at which fabric guide chute 43 first contacts filter fabric 38 (i.e., supporting edge 45), the outer surface of fabric guide chute 43 is bent upward in a substantially vertical direction along a line extending diagonally toward an opposite corner of fabric guide chute 43. The vertical bend along the outer surface of fabric guide chute 43 extends from supporting edge 45 to the position at which guide bar 60 is provided on fabric guide chute 43.

At the position at which guide bar 60 is provided on fabric guide chute 43, a second bend is introduced into the outer surface of fabric guide chute 43. Specifically, the outer surface is again bent approximately another 90° such that the outer surface of fabric guide chute 43, from guide bar 60 diagonally downward toward the end of fabric guide chute 43, is facing in an upward direction. The line along which this second bend is made in the outer surface of fabric guide chute 43 extends from the position of guide bar 60 diagonally downward toward the trench to a point 62 proximate the trench. Point 62 is located on the same edge of fabric guide chute 43 from which the first bend starts.

At point 62 there is provided a horn 64 for further maintaining filter fabric 38 substantially adjacent the outer surface of fabric guide chute 43. Horn 64 is a conically-shaped element movably mounted to fabric guide chute 43 by means of an adjustable horn support 66. Horn 64 is rotatably coupled to support 66 so that the particular orientation of horn 64 at any given time may be adjusted. The tip of horn 64 is pointing at a downward angle and is substantially adjacent to the bottom of the trench.

Horn 64 performs a function similar to that of guide bar 60, that is, that portion of filter fabric 38 that is adjacent the portion of the outer surface of fabric guide chute 43 that faces in a substantially vertical upward direction is held in place by horn 64.

At the point where horn 64 is mounted to fabric guide chute 43, the outer surface of fabric guide chute 43 is bent again. Specifically, the outer surface of fabric guide chute 43 is bent in two directions so that the outer surface of fabric guide chute 43 forms a right angle. The bottom portion of the right angle (that is, the bottom portion of fabric guide chute 43) is bent so as to be parallel with and just above the bottom of the trench. The side portion of the right angle (i.e., the side of fabric guide chute 43) is bent to extend in a substantially vertical direction and is positioned along the outer side wall of the trench. This particular orientation of fabric guide chute 43, with one surface resting near the bottom of the trench and a second surface adjacent the outer side wall of the trench, is present from horn 64 to the distal end of the fabric guide chute 43 adjacent the trench (that is, to the left in, for example, FIGS. 3A and 4A).

The particular configuration of fabric guide chute 43 described herein imparts an optimal shape to filter fabric 38 so that filter fabric 38 can be most effectively folded and laid adjacent only the bottom and outer side wall surfaces of the trench. The desired folds are imparted to filter fabric 38 because filter fabric 38 is retained adjacent the outer surface of fabric guide chute 43 by guide bar 60 and horn 64.

In operation, at supporting edge 45 the outer surface of fabric guide chute 43, as well as filter fabric 38 held thereto, are substantially parallel with the bottom of the trench. As filter fabric 38 is extended from supporting edge 45 diagonally downward toward the trench, an increasing portion of the outer surface of fabric guide chute 43 becomes substantially vertical due to the bend provided in fabric guide chute 43. As a result, in that portion of fabric guide chute 43 between supporting edge 45 and guide bar 60, filter fabric 38 is folded by the bend in fabric guide chute 43 so that part of filter fabric 38 (adjacent the unbent, diagonally downwardly-facing portion of fabric guide chute 43) remains substantially parallel with the bottom of the trench, while a second portion of filter fabric 38 (adjacent the bent, substantially vertical portion of fabric guide chute 43) is folded in a substantially vertical direction.

At the position of guide bar 60, filter fabric 38 is folded again. As a result, from the position of guide bar 60 to point 62, filter fabric 38 is oriented in three different directions. That is, a first portion of filter fabric 38 that is adjacent the portion of the outer surface of fabric guide chute 43 that is facing diagonally downward toward the trench is oriented in a first direction. The second portion of filter fabric 38 that is adjacent the portion of the outer surface of fabric guide chute 43 that is bent substantially vertically along the first bend is oriented in a second direction. And, the portion of filter fabric 38 that is adjacent the portion of the outer surface of fabric guide chute 43 that is bent again to a substantially horizontal position facing diagonally upward away from the trench is oriented as well in a third direction.

At horn 64, filter fabric 38 is again folded, after which filter fabric 38 is oriented in two different directions. First, the portion of the outer surface of fabric guide chute 43 that was previously facing diagonally upward is oriented in a substantially vertical direction aft of horn 64. Second, the portion of the outer surface of fabric guide chute 43 that was previously facing diagonally downward toward the trench faces horizontally downward parallel with the bottom of the trench from horn 64 to the distal end of fabric guide chute 43.

The particular configuration described above, and particularly the provision of horn 64 to ensure a second bend to filter fabric 38 immediately prior to filter fabric 38 being laid in the trench is advantageous in view of the environment in which fabric guide chute 43 must lay filter fabric 38. That is, in operation, the distal end of fabric guide chute 43 is positioned just above the bottom of the trench, while the other end of fabric guide chute 43 (i.e., at supporting edge 45) is positioned at frame 44 some distance above the trench bottom. As a result, filter fabric 38 must travel diagonally downward adjacent the outer surface of fabric guide chute 43 until filter fabric 38 reaches horn 64, at which point filter fabric 38 is bent in a horizontal direction to rest on the bottom of the trench. Without horn 64, this change in the orientation of the portion of filter fabric 38 that lines the bottom of the trench would cause a severe pucker or wrinkle in that portion of filter fabric 38 which lines the outer side wall of the trench (that is, the side wall farthest from the road). Such a pucker or wrinkle in filter fabric 38 would result in imperfections such as unwanted pockets formed between filter fabric 38 and the outer side wall of the trench when the outer side wall of the trench is lined with filter fabric 38.

Thus, to clarify, as a result of the particular configuration described herein, and specifically by locating horn 64 in the bends of fabric guide chute 43, the present invention secures filter fabric 38 in an orientation to which it is already biased. That is, because of the junction of fabric guide chute 43 (which occurs at the position of horn 64) where the diagonally downward facing outside portion thereof meets the distal portion of fabric guide chute 43, which skims the bottom of the trench, the portions of filter fabric 38 adjacent the corresponding side portions of fabric guide chute 43 experience a tendency to pucker or wrinkle. Horn 64, and the bends in fabric guide chute 43 corresponding thereto, secure filter fabric 38 at the location where such puckers would otherwise be formed, thus keeping filter fabric 38 taut and wrinkle free.

Figure 7B:
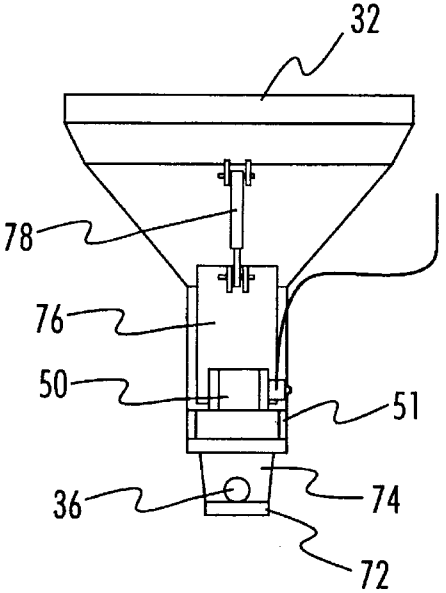
FIGS. 7A and 7B are side and end views, respectively, of a hopper comprising part of the drain preparation apparatus illustrated in FIGS. 1 and 2.
Figure 7A:
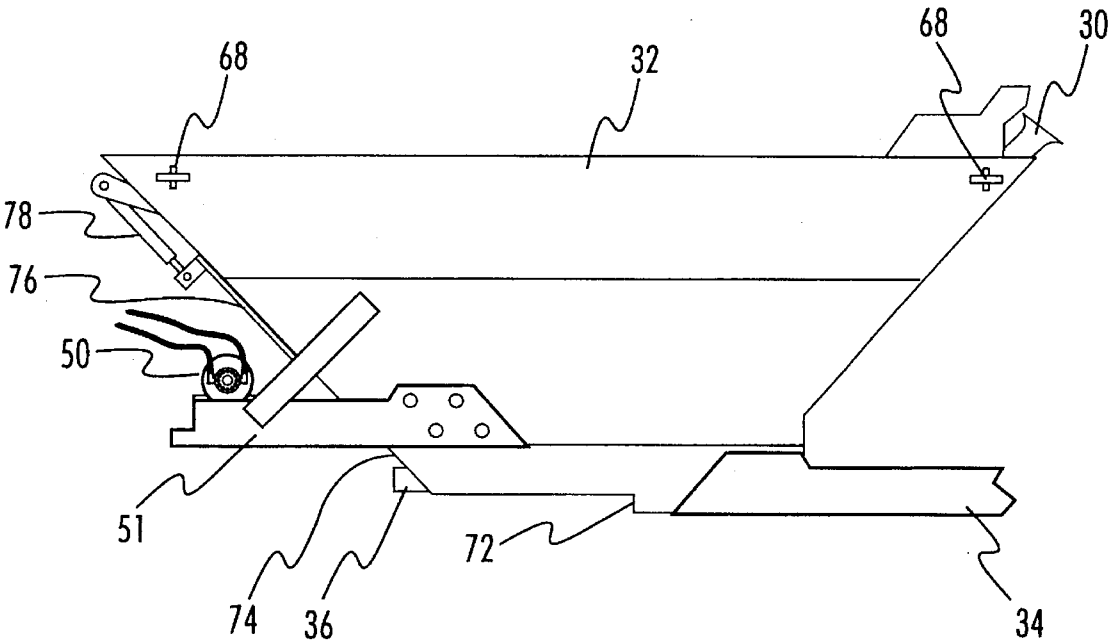

Referring now to FIGS. 7A and 7B, there are illustrated a side view and a front view, respectively, of hopper 32 and associated elements. As shown therein, so that hopper 32 may be vibrated by vibrator 50 without excessive vibration being transferred to frame 44, hopper 32 may be mounted on frame 44 using a plurality of rubber mounts 68 or the like located proximate each the four corners of the top portion of hopper 32. The particular size, location and configuration of rubber mounts 68 is not crucial and may be readily altered by those of ordinary skill in the art without departing from the spirit or scope of the present invention.

Hopper 32 includes at least two openings therein, thereby permitting bulk material placed in hopper 32 to be poured into the trench. A first opening 72 in the bottom of hopper 32 is disposed below exit portion 36 and permits the pouring of the first layer of bulk material onto filter fabric 38 (which has already been laid along the bottom and outer side wall of the trench). Drain pipe 26 is fed out of exit portion 36 to rest on top of this first layer of bulk material. A second opening 74 in hopper 32 is disposed above exit portion 36 and enables the pouring of the second layer of bulk material from hopper 32 onto drain pipe 26 to thereby cover drain pipe 26 and fill the trench.

Second opening 74 is controlled by a sliding gate 76 (shown in the Figures in an open position). Gate 76 is sized to be large enough to cover some or all of second opening 74 and thereby regulate the flow of the bulk material through second opening 74. For example, gate 76 may be moved to close gate 76 when drain preparation apparatus 24 approaches a lateral drain. In such cases, drain preparation apparatus 24 will continue to position filter fabric 38 along the bottom and one side wall of the trench, pour the first layer of bulk material onto filter fabric 38 and lay drain pipe 26 on the first layer of bulk material, as described herein. Drain preparation apparatus 24 will not, however, pour the second layer of bulk material, thus leaving drain pipe 26 exposed. By so doing, drain preparation apparatus 24 permits the operator to tie together adjoining drain pipes 26 at laterals or other locations.

The position of gate 76 may be moved by a hydraulic cylinder 78 or the like, as will be appreciated by those of ordinary skill in the art. Preferably, hydraulic cylinder 78 may be controlled by controls 48.

Figure 8A:
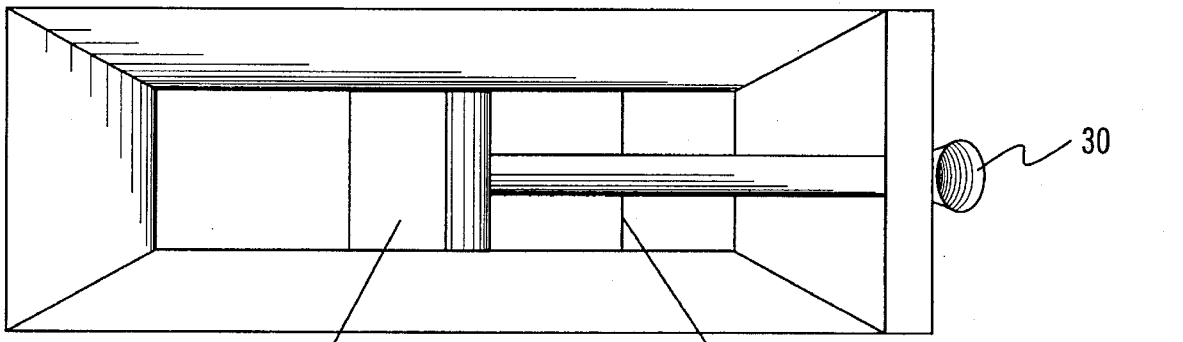
FIG. 8A is a top view of the hopper illustrated in FIGS. 7A and 7B and FIGS. 8B and 8C illustrate various exemplary vibrators used in connection with the hopper illustrated in FIG. 8A.
Figure 8B:
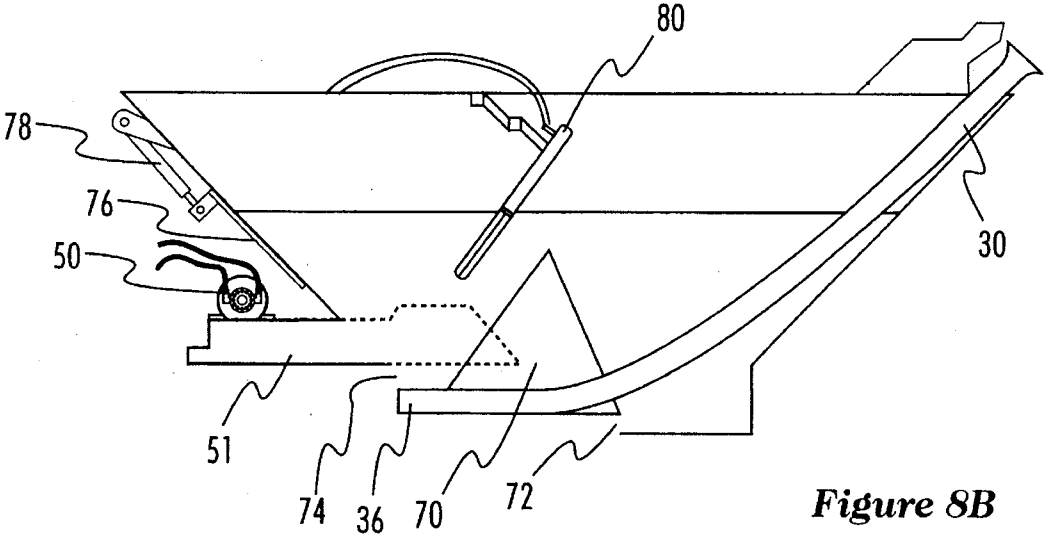
Figure 8C:
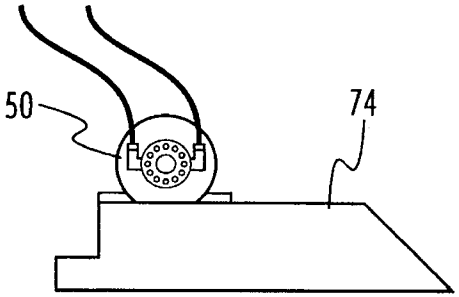

As shown in FIGS. 8A and 8B, the inside of hopper 32 is provided with a divider 70. Divider 70 is made of metal or other similar sturdy construction and is formed in the shape of a triangle. The triangular shape of divider 70 facilitates the flow of the bulk material toward the bottom of hopper 32. Divider 70 extends across the width of hopper 32, the ends of divider 70 being fixed to the inner portions of the side walls of hopper 32. Divider 70 is positioned within the inside of hopper 32 such that a top edge of the triangle is facing upward out of hopper 32. Divider 70 is recessed within hopper 32 such that the top edge of divider 70 is below the top of hopper 32 by a predetermined distance, such as, for example, 20" to 24". Alternatively, the top edge of divider 70 may extend up to the top edge of hopper 32. The bottom surface of divider 70 (i.e., the base of the triangle) is positioned a predetermined distance above the bottom of hopper 32. This predetermined distance will be the same as the depth of the first layer of bulk material poured by hopper 32. The particular dimensions of divider 70 will depend on a number of factors, including the size of hopper 32 and the desired depth of the first layer of bulk material.

Divider 70 effectively divides hopper 32 into a front portion and a rear portion. As the bulk material is poured into hopper 32, portions of the bulk material will settle into either the front portion or the rear portion of hopper 32 depending upon which side of the top edge of divider 70 the bulk material is poured. As will be appreciated by those of ordinary skill in the art, first opening 72 and second opening 74 are located in different portions of hopper 32. As a result, bulk material poured into the front portion of hopper 32 (looking, for example, to the right in FIGS. 7A and 9), will pass out of first opening 72, thus forming the first layer of bulk material which is laid directly on filter fabric 38. Bulk material poured into the rear portion of hopper 32, on the other hand, will pass to the rear of divider 70 and be poured out of second opening 74, thus forming the second layer of bulk material which is laid on drain pipe 26 and which ultimately fills the trench.

For example, as hopper 32 is filled with bulk material above the top of divider 70, the front and rear portions of hopper 32 will be accommodated simultaneously. Divider 70 could be extended to the top of hopper 32, thus permitting the operator to easily use different bulk materials in the front and rear portions of hopper 32. In such a case, a first type of bulk material loaded in the front portion of hopper 32 will exit hopper 32 through first opening 72, thus forming the first layer of bulk material. A second type of bulk material loaded in the rear portion of hopper 32 will thus exit hopper 32 through second opening 74 and form the second layer of bulk material.

Figure 9:
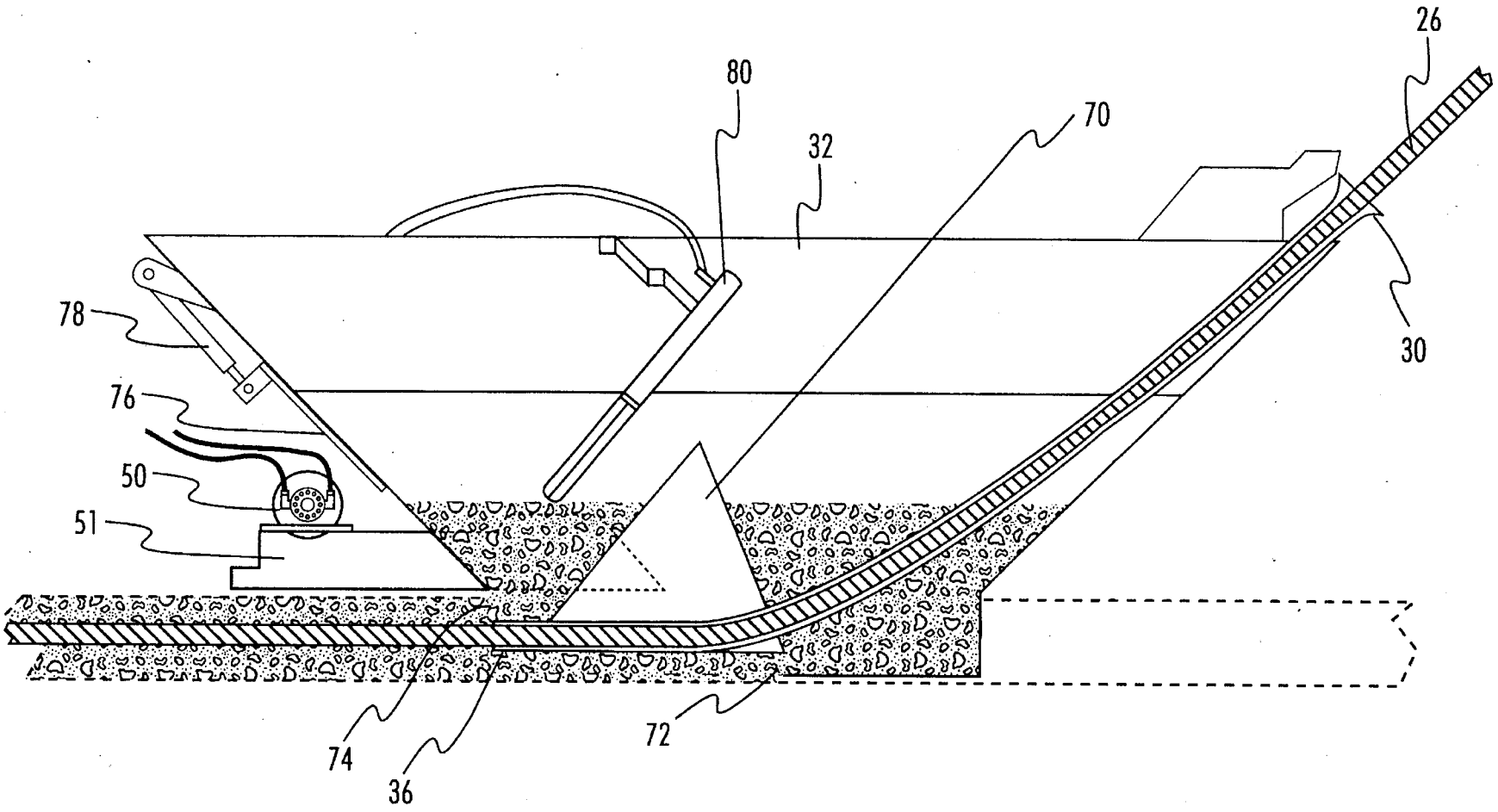
FIG. 9 is a side view of the hopper illustrated in FIG. 7A through 8C in operation.
Figure 10B:
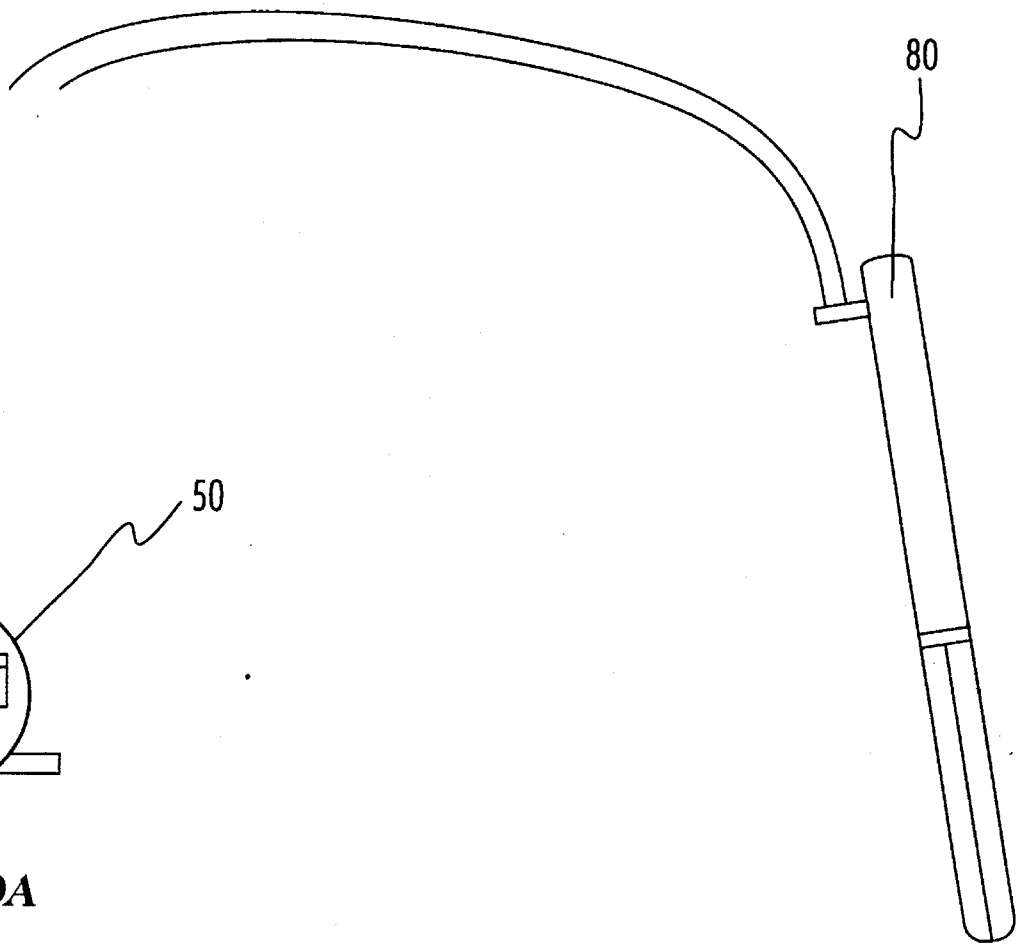
FIGS. 10A and 10B illustrate the vibrators shown in FIGS. 8B and 8C.
Figure 10A:
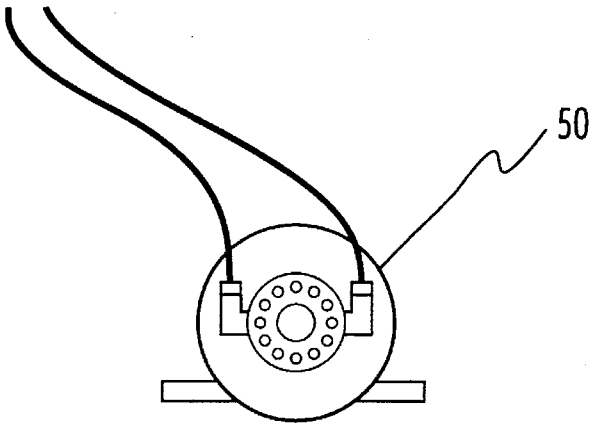

As shown in FIGS. 9 and 10B, there may also be provided a second vibrator 80 to facilitate the flow of bulk material through first and second openings 72, 74 in hopper 32. Vibrator 80 may be disposed in either portion of hopper created by divider 70, but is preferably provided in the rear portion, that is, the portion including second opening 74 (through which most of the bulk material passes). Vibrator 80 may, for example, be a Model 939700 hydraulic concrete linear vibrator available from The Wyco Tool Company of Racine, Wis. However, the particular construction of vibrator 80 is not crucial to the practice of the present invention, as will be understood to those of ordinary skill in the art.

Figure 11:
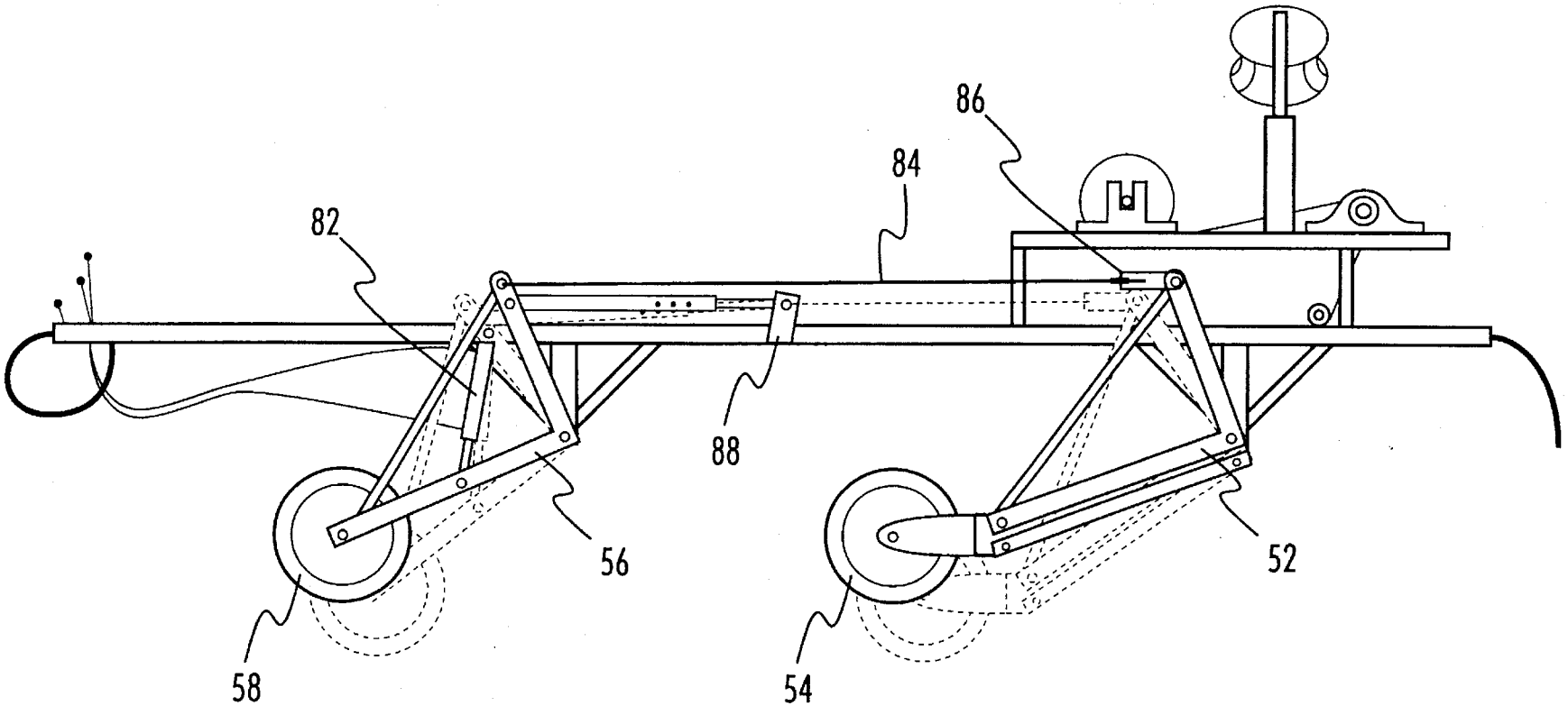
FIG. 11 illustrates various elements used to control the height of the drain preparation apparatus illustrated in FIGS. 1 and 2.

Referring to FIG. 11, there are illustrated the elements comprising the presently contemplated best mode for controlling the height of front and rear wheels 54, 58 of drain preparation apparatus 24. The height of each left and right rear wheels 58 is preferably controlled by hydraulic lifters 82 or the like. Specifically, hydraulic lifters 82 are used to raise left and right rear wheels 58, while the wheels 58 are lowered by gravity. An adjusting screw 88 is provided for each of the left and right rear wheels to determine the lowest position to which hopper 32 can be lowered. That is, because front and rear wheels 54, 58 cannot be lowered when drain preparation apparatus 24 is already on the ground, hydraulic lifters 82 in effect "lower" the wheels by raising hopper 32. Preferably, separate lifters 82 are provided for controlling each of the rear wheels 58 in view of the likelihood that the ground under each of the rear wheels will be at different levels. The height difference between the left and right rear wheels 58 may be as much as 12" or more. Hydraulic lifters 58 may be controlled by controls 48.

Each of left and right rear leg assemblies 56 is connected to a first end of a pull rod 84 or other connecting means, the other end of which is connected to the corresponding left or right front leg assembly 52. As a result, as the rear leg assemblies 56 are raised and lowered, the front leg assemblies 52 are raised and lowered accordingly. Each of left and right pull rods 84 is provided with an adjusting nut 86 to adjust the height of front wheels 54 relative to rear wheels 58. That is, although the height of front wheels 54 is a function of the height of rear wheels 58, a bias between the respective front and rear wheels 54, 58 may be set, as desired by the operator, using adjusting nut 86.

Drain preparation apparatus 24, as described and illustrated herein, may thus, in a single pass, line the bottom and a single side wall of the trench with a filter material, lay a first layer of bulk material on the filter material, lay a drain pipe on the first layer of bulk material and lay a second layer of bulk material on the drain pipe to cover the pipe and fill the trench. Specifically, filter fabric 38 is fed over filter fabric roller 42 and is guided and folded by the bends in fabric guide chute 43, guide bar 60 and horn 64 until filter fabric 38 is laid against the bottom and outer side wall of the trench. A first layer of bulk material is then dispensed from hopper 32 through first opening 72 on top of the filter fabric 38 just laid. Drain pipe 26 is then dispensed through pipe chute 30 and out of exit portion 36 to rest on the first layer of bulk material. A second layer of bulk material is then dispensed from hopper 32 through second opening 74 to cover drain pipe 26 and fill the trench. When the location for a lateral drain is reached, the flow of the second (i.e., top) layer of bulk material is cut off by gate 76 to allow for access to drain pipe 26 to install a "T" so as to feed water away from the road through the lateral drain.

Figures 12A, 12B:
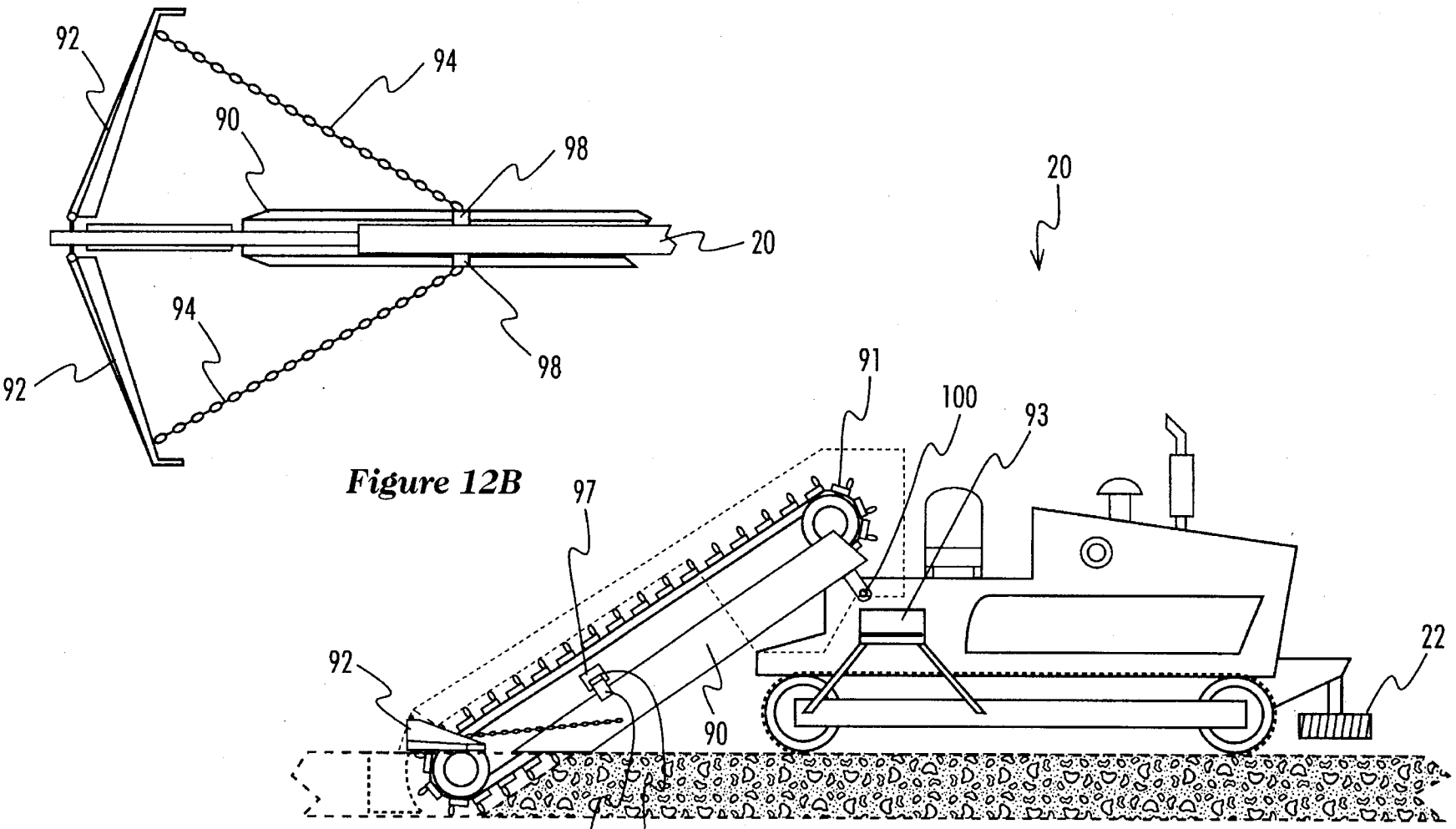
FIG. 12A is a side view illustrating a portion of the conventional trenching machine illustrated in FIG. 1, adapted with a soil recovery box according to the present invention.
FIG. 12B is a top view illustrating a portion of the conventional trenching machine illustrated in FIG. 1, adapted with a soil recovery box according to the present invention.

Referring now to FIG. 12A, there is illustrated a soil recovery box 90 for use with drain preparation apparatus 24 and conventional trenching machine 20. Soil recovery box 90 is made of metal or other suitable durable construction and is configured to be removably mounted beneath the lower portion of digging chain 91 of trenching machine 20. Specifically, the lower portion of soil recovery box 90 is positioned and angled to rest upon the surface of the ground just ahead of digging chain 91. That is, in operation, as trenching machine 20 advances, soil is pulled out of the trench by digging chain 91, which rotates in a counterclockwise direction (as viewed in FIG. 12A). The soil lifted by digging chain 91 is thus received in the lower portion of soil recovery box 90 (i.e., that portion substantially at ground level). Without soil recovery box 90, digging chain 91 would pull soil out of the trench and pile the soil on both sides and in front of the trench. According to the present invention, because of the presence of soil recovery box 90, as soil is lifted by digging chain 91, the soil will not fall from the teeth of digging chain 91 to the sides or in front of the ditch as the soil is being lifted, but instead the soil will be advanced diagonally upward by the teeth of digging chain 91 through soil recovery box 90 until the soil can be removed by a conventional conveyor 93 or the like provided on trenching machine 20 adjacent to a top portion of digging chain 91.

Preferably, the mounting of soil recovery box 90 onto the boom of trenching machine 20 is done in a flexible manner, that is, soil recovery box 90 preferably may move or "float" relative to the position of the boom. This is accomplished by securing a mounting bracket 96, which may be made of metal or other sturdy material, onto each side wall of soil recovery box 90 at an intermediate position thereon. Specifically, each mounting bracket 96 is positioned adjacent an opening 97, which extends laterally through the boom of trenching machine 20. Opening 97 is provided on conventional trenching machine 20 to permit inspection, maintenance and the like of the boom. A floating retaining bar 98, made of metal or the like, is provided and extends laterally through opening 97. The length of floating retaining bar 98 is such that bar 98 extends through opening 97 on either side thereof, where it is secured to each of the left and right mounting brackets 96.

Floating retaining bar 98 is not otherwise retained within opening 97. As a result, floating retaining bar can move within opening 97 and thus "float" in relation to the position of the boom. Upper portion of soil recovery box 90 is also pivotally mounted at an upper end thereof to trenching machine 20 by means of a pivotal mount or the like 100.

As described herein, soil recovery box 90 catches substantially all of the soil removed from the trench by the teeth of digging chain 91, except for small pieces of soil that splatter out of box 90 and onto the ground. In accordance with the present invention, this spilled soil is fed back into the trench by a pair of side slides 92, illustrated in FIGS. 12A and 12B, which are mounted on a lower end portion of the boom of trenching machine 20 behind soil recovery box 90. Side slides 92 are configured and positioned to skim the ground surface as trenching machine 20 advances and are angled to direct soil spilled on the ground back into the trench. Side slides 92 may be retained, and the angle of side slides 92 may be adjusted, by a pair of retaining chains 94 which preferably extend from distal end portions of side slides 92 to side portions of soil recovery box 90 adjacent mounting brackets 96.

Additional features and variations may be implemented to the specific preferred embodiment discussed herein. For example, frame 44 may be provided adjacent mounting brackets 40 with a rack or the like on which a sewing machine (not shown) may be provided. The sewing machine may be used to connect a new roll of filter fabric 38 to a roll which has been laid in the trench while drain preparation apparatus 24 is in operation or may be used to mend damaged filter fabric before it is laid in the trench.

In addition, fabric guide chute 43, and components associated therewith such as, for example, guide bar 60 and horn 64, may be removed from frame 44 at supporting edge 45 and replaced by a complementary fabric guide chute 43, guide bar 60 and horn 64 so that the drain preparation apparatus 24 of the present invention may effectively lay filter fabric 38 in trenches provided on either side of the road while traveling in direction of flow of traffic.

Similarly, pipe chute 30 may be replaced by other suitable guide means for effectively laying drain pipe 26 on top of the first layer of bulk material and may be further adapted to accommodate drain pipe 26 of different sizes.

There may also be provided wheels or other suitable slidable elements, mounted, for example, to frame 44 or to hopper centering guide 34 and positioned along the bottom of the trench, to smooth filter fabric 38 after it has been positioned on the bottom of the trench, but before the first layer of bulk material has been poured out of first opening 72. Other suitable means may be provided to suitably smooth filter fabric 38 after it has been positioned along a side wall of the trench.

Means, such as a gate or the like, may also be provided to control the flow of the first layer of bulk material through first opening 72.

It is intended that the specification and examples be considered as exemplary only, with the true scope and spirit of the invention being indicated by the following claims.

What is claimed is:

1. An apparatus for preparing a drain from a trench in a single pass through the trench by lining the trench with an unrolling length of filter fabric, a first layer of bulk material, a drain pipe and a second layer of bulk material, the apparatus comprising:

a fabric guide chute for guiding the unrolling filter fabric into the trench, the filter fabric being positioned in the trench adjacent the bottom and one side wall thereof;

a pipe chute, having an exit portion, for laying the drain pipe on the first layer of bulk material in the trench; and a hopper, said hopper being provided with the bulk material therein and having a first opening in a forward section of the hopper through which the first layer of bulk material is poured into the trench onto the filter fabric, and having a second opening in a rearward section of the hopper through which the second layer of bulk material is poured into the trench onto the drain pipe.

2. An apparatus according to claim 1, further comprising a gate for closing said second opening independently of said first opening.

3. An apparatus according to claim 1, wherein the guide chute defines a path that causes the unrolling filter fabric to be folded longitudinally along an intermediate portion thereof as the fabric passes through said guide chute, said fold defining first and second portions of the filter fabric that are oriented at an angle of approximately 90° relative to each other, such that the first portion of the filter fabric is laid along the bottom of the trench and the second portion of the filter fabric is laid along an outer side wall of the trench.

4. An apparatus according to claim 1, further comprising a horizontal roller for riding atop the unrolling filter fabric and feeding said fabric to the guide chute in a substantially flat orientation and wherein the guide chute comprises the combination of (a) an elongated form having a head end, a foot end, and an external, fabric-shaping surface comprised of an underside bounded along a first lengthwise edge by an upstanding side wall having a bottom edge that coincides with said first lengthwise edge of the underside, said head end being proximate said roller, and said form being so oriented that, as the apparatus travels through the trench, the unrolling fabric is pulled under said roller and then lengthwise along the fabric-shaping surface of said form, from the head end to the foot end, said fabric-shaping surface defining path that, if the fabric is forced to conform to said surface, causes the fabric to be folded longitudinally so as to take on an L-shaped cross-section, with the vertical arm of the L being adjacent the side wall of the trench and the horizontal arm of the L being adjacent the bottom of the trench, and (b) means for pressing the unrolling fabric against the side wall of said form.

5. An apparatus according to claim 4, wherein the side wall has a top edge; the underside of said form has a second lengthwise edge that is substantiality perpendicular to the horizontal roller; the first lengthwise edge of the underside angles toward the second edge in the region between the head end and an inside bend line in the sidewall that (i) is substantially perpendicular to the underside, (ii) extends from the side wall's bottom edge to its top edge, and (iii) is located intermediate the head and foot ends of the form; in the region between said inside bend Line and the foot end, the first and second lengthwise edges of the underside are substantially parallel to one another; the side wall has a first exterior face extending from said head end to said inside bend line, a second exterior face extending from said bend line to a substantially V-shaped indentation in the side wall that is arranged with its apex at the bottom edge of the side wall, said indentation being located intermediate the inside bend line and the foot end of the form, and a third exterior face extending from said indentation to the foot end of the form, said second exterior face being substantially triangular and having a diagonal upper edge that extends from the point where the bend line intersects with the top edge of the side wall to the adex of the V-shaped indentation, and said third exterior face being substantially perpendicular to the plane of the adjacent underside; and the underside of the form slants downward from the head end to the indentation but is substantially horizontal from the indentation to the foot end; said chute further comprising means for pulling the adjacent portion of the passing fabric into the indentation, thereby placing sufficient tension on the fabric to decrease the tendency for wrinkles to form in the portion of the fabric that is placed against the side wall of the trench.

6. An apparatus according to claim 1, wherein said pipe chute is enclosed extends through said hopper and opens at a location rearward of said first opening in the hopper, so that, when said apparatus is in operation, said first layer of bulk material is in place before the drain pipe emerges from the chute and is laid thereon.

7. An apparatus according to claim 1, wherein said hopper further comprises a divider for dividing said hopper into at least a first and second portion, said first opening being located in said first portion and said second opening being located in said second portion.

8. An apparatus according to claim 7, wherein said hopper has a top and a width, and wherein said divider is a tent-shaped member with a topmost ridge that extends across the width of the hopper, said tent-shaped member dividing the hopper into front and rear portions.

9. An apparatus according to claim 8, wherein the topmost ridge of said divider is substantially even with the top of said hopper.

10. An apparatus according to claim 8, wherein the topmost ridge of said divider is recessed below the top of said hopper.

11. An apparatus according to claim 1, further comprising a frame, said fabric guide chute, said pipe chute and said hopper each being mounted on said frame.

12. An apparatus according to claim 11, wherein said hopper is mounted on said frame using at least two rubber mounts.

13. An apparatus according to claim 11, wherein said frame is adapted to be pulled by a trenching machine.

14. An apparatus according to claim 11, wherein said frame is supported by four ground-engaging wheels positioned so as to place two of said wheels on each side of the trench as the apparatus passes through the trench, and the frame also carries propulsion means for propelling the apparatus through a trench.

15. An apparatus according to claim 1, further comprising at least one vibrator for facilitating a flow of the bulk material through at least one of said first and second openings.

16. An apparatus according to claim 15, wherein said at least one vibrator comprises a rotary vibrator.

17. An apparatus according to claim 13, wherein said at least one vibrator comprises a linear vibrator.

18. An apparatus according to claim 17, wherein said at least one vibrator comprises rotary vibrator and a linear vibrator.

19. An apparatus according to claim 1, further comprising a roll for holding the filter fabric, said roll being positioned above said guide chute.

20. An apparatus according to claim 19, further comprising means for adjusting a position of said roll of filter fabric.

21. An apparatus according to claim 19, further comprising a tension applying element for maintaining a tension of the filter fabric on said roll.

22. An apparatus according to claim 1, wherein the apparatus comprises (a) four ground-engaging wheels positioned so as to place two of said wheels on each side of the trench as the apparatus passes through the trench, and (b) a centering guide, coupled to said hopper, for centering the apparatus in the trench, said guide comprising an elongated beam member protruding forward of all four of said ground-engaging wheels, in the direction of travel of the apparatus.

23. An apparatus according to claim 13, further comprising a resilient guide wheel, adapted to be mounted in a substantially horizontal direction to a front portion of the trenching machine, for maintaining a predetermined direction of travel of the trenching machine and for maintaining the trenching machine a predetermined distance from a vertical surface.

24. An apparatus according to claim 23, further comprising means for adjusting a position of said guide wheel.

25. An apparatus according to claim 11, further comprising a rack, mounted on said frame, said rack supporting a sewing machine adapted to sew together separate lengths of the filter fabric, in an end-to-end relationship, while the travel of the apparatus through the trench is temporarily halted.

26. An apparatus according to claim 1, further comprising:

left and right front leg assemblies, each of said left and right front leg assemblies supporting a wheel;

left and right rear leg assemblies, each of said left and right rear leg assemblies supporting a wheel;

means for lifting each of said left and right rear leg assemblies; and first and second pull rods, said first pull rod connecting said left rear leg assembly to said left front leg assembly and said second pull rod connecting said right rear leg assembly to said right front leg assembly, the positions of said left and right front leg assemblies thereby being adjustable in accordance with the positions of said left and right rear leg assemblies.

27. An apparatus according to claim 26, wherein said lifting means lifts each of said left and right rear leg assemblies individually.

28. An apparatus according to claim 27, wherein said left and right rear leg assemblies may be lifted to heights differing up to approximately 12".

29. An apparatus according to claim 1, further comprising fabric-engaging means located forward of said first opening in the hopper for smoothing said filter fabric positioned adjacent the bottom of the trench, prior to the bulk material being poured onto the fabric.

30. An apparatus according to claim 4, further comprising means for engaging and smoothing said filter fabric after it has been positioned adjacent the side wall of the trench.

31. A method of preparing a drain from a trench by lining the trench with a filter fabric, a first layer of bulk material, a drain pipe and a second layer of bulk material, the method comprising the steps of:

guiding an unrolling length of the filter fabric into the trench, the filter fabric being positioned in the trench adjacent the bottom and one side wall thereof;

pouring a first layer of the bulk material into the trench onto the filter fabric through a first opening provided in a hopper containing the bulk material;

laying the drain pipe into the trench on top of the first layer of bulk material; and pouring a second layer of the bulk material into the trench onto the drain pipe through a second opening provided in said hopper.

32. A method according to claim 31, wherein; in the step of guiding the filter fabric into the trench, the filter fabric is pulled lengthwise along a fabric-shaping surface of an elongated form, said surface defining a path that causes the unrolling filter fabric to be folded longitudinally along an intermediate portion thereof, said fold defining first and second portions of the filter fabric that are oriented at an angle of approximately 90° relative to each other, such that the first portion of the filter fabric is laid along the bottom of the trench and the second portion of the filter fabric is laid along an outer side wall of the trench.

33. A method according to claim 31, further comprising the step of controlling a position of a gate slidably positioned to cover said second opening, the position of said gate controlling an amount of flow of said bulk material through said second opening, without controlling the flow of bulk material through said first opening.

34. An apparatus according to claim 12, wherein said hopper is mounted on said frame using four rubber mounts.

35. An apparatus according to claim 1, further comprising a roller for guiding the filter fabric to said fabric guide chute, said roller being longitudinally adjustable to vary the position of the filter fabric on said fabric guide chute.

36. An apparatus according to claim 5, wherein said means for pressing the unrolling fabric against the side wall of the form includes means for guiding the upstanding edge of the passing fabric into the inside bend line in the sidewall.

37. In a trenching machine having a diagonally oriented, circulating digging chain that emerges from the ground with soil removed from the ground, the improvement wherein the machine includes:

a) an elongated soil collecting box positioned below the digging chain, substantially parallel thereto, and extending substantially the entire length of the chain that is above ground when the machine is in operation, said box being open at its upper end and its lower end and serving to collect soil that falls from the digging chain and hold said soil close enough to the circulating chain to permit the chain to advance said soil up the box to its upper end;

b) means adjacent the upper end of said collecting box for removing soil advanced thereto by said circulating chain; and c) a pair of angled side slides mounted rearward of said soil collecting box, said slides being configured and positioned to skim the ground surface along both sides of the trench as the trenching machine advances and direct soil that splatters out of said collecting box back into the trench.

38. The apparatus according to claim 5, wherein said means for pulling the passing fabric into the V-shaped indentation comprises a complementarily shaped horn that is mounted point down in said indentation, so as to permit the horn to ride against the outside surface of the top edge of the passing fabric and deflect the top edge of the fabric into the indentation.

* * * * *

UNITED STATES PATENT AND TRADEMARK OFFICE

CERTIFICATE OF CORRECTION

PATENT NO. : 5,573,347

DATED : November 12, 1996

INVENTOR(S) : ROBERT K. MILES, ET AL.

It is certified that error appears in the above-indentified patent and that said Letters Patent is hereby corrected as shown below:

COLUMN 2:

Line 42, ".et al." should read --et al.--.

COLUMN 3:

Line 66, "FIG. 7A" should read --FIGS. 7A--.

COLUMN 14:

Line 41, "orientation and" should read --orientation, and--; and

Line 54, "defining path" should read --defining a path--.

COLUMN 17:

Line 16, "wherein; in" should read --wherein, in--.

Signed and Sealed this

Eleventh Day of March, 1997

*Attest:*

Bruce Lehman

BRUCE LEHMAN

*Attesting Officer*

*Commissioner of Patents and Trademarks*